United States Patent [19]

Guy et al.

[11] 4,351,370

[45] Sep. 28, 1982

[54] YARN BRAKE FOR A TEXTILE MACHINE

[75] Inventors: David A. Guy, Matthews; Philip A. Nims, Charlotte, both of N.C.

[73] Assignee: Crompton & Knowles Corporation, New York, N.Y.

[21] Appl. No.: 146,879

[22] Filed: May 5, 1980

[51] Int. Cl.[3] ..... D03D 47/30

[52] U.S. Cl. ..... 139/450; 139/429; 139/453; 112/155

[58] Field of Search ..... 139/429, 435, 450, 452; 112/DIG. 3, 154, 155; 242/150

[56] References Cited

U.S. PATENT DOCUMENTS 3,565,121 2/1971 Svaty ..... 139/453
4,192,357 3/1980 Tanaka et al. ..... 139/450

FOREIGN PATENT DOCUMENTS 47-51986 12/1972 Japan ..... 139/45

*Primary Examiner*—Henry Jaudon

[57] ABSTRACT

A yarn brake for a textile machine. The yarn brake comprises a stationary clamping plate and a movable clamping plate. The plates are forced together by first and second biasing means to provide full braking pressure on a yarn passing between the plates. De-activating means operate to selectively nullify the effect of the second biasing means to provide partial braking pressure on the yarn, or to nullify the effects of both biasing means so that there is no braking pressure on the yarn. The invention also includes a weft yarn braking system for a multi-weft loom utilizing a yarn brake of the present invention for each weft yarn. Control means, operating in timed relation to the loom, operate the brakes in a programmed sequence. The yarns are fully braked when not being inserted into the loom. When a weft yarn is inserted into the loom, its brake is fully de-activated so that there is no braking pressure on the yarn during the major portions of its insertion into the loom and the brake is partially de-activated during the latter portion of said insertion to provide partial braking of the yarn.

16 Claims, 11 Drawing Figures

YARN BRAKE FOR A TEXTILE MACHINE

BACKGROUND OF THE INVENTION

This invention relates generally to a yarn brake and particularly to a weft yarn braking system for a weaving machine or loom that utilizes a plurality of weft yarns and inserts said yarns selectively into a warp shed.

Multiple weft looms have been known, wherein a multiple weft yarn supply is positioned outside of the warp shed along with a weft yarn braking mechanism. The yarn braking mechanism is usually actuated by means of an operative connection to the loom, so as to release a particular weft yarn at the start of the picking operation. For example, the yarn braking mechanism is connected by a cam which is driven by the main shaft of the loom. In use, the cam releases the yarn brake at a particular point during the cycle of the loom operation and re-applies the yaarn brake at some other period of time during the cycle. The later periods of time have always been predetermined and have always been the same.

In another known loom illustrated in U.S. Pat. No. 3,565,121 issued on Feb. 23, 1971 to Vladimir Svaty for weft selecting and presenting apparatus, several differently colored weft yarns are fed through a single braking means of the loom. In this loom, only the selected weft yarn is clamped by the braking means and tensioned by the tensioning means during insertion into the gripper shuttle and after the pick of the gripper shuttle. The selected weft yarn is untensioned during the weft insertion cycle of the loom. In this loom, the yarns which were not selected remain untensioned and are not clamped. The weft yarns on one end of the loom all pass through or between two braking members, one of which is fixed and the other which is movable against the fixed braking member. The movable braking member is urged by a spring against the fixed member so as to exert a light tension on the yarn, so that the yarn can be taken off of the supply bobbin without causing yarn breakage or uncontrolled unwinding. This braking means, however, includes an electromagnetic coil which is selectively energized to clamp the weft yarn to prevent the yarn from being unwound from the supply bobbin. When it is desired to pick yarn from one particular end, the coil is de-energized so that the yarn may be drawn through the yarn braking device with very little tension being exerted thereon.

This device has two significant disadvantages. The first one is that light tension has to be applied to the yarn at all times by the spring urging the movable member towards the fixed member, even during the yarn insertion phase of the loom. This, in turn, causes undue wear on the parts which must guide the yarn into the warp shed and puts an undue strain on the yarn itself, and thus limits the speed of weft insertion. The second disadvantage is that the yarns not being inserted into the warp shed but passing through the same tension device or weft braking device will only be lightly gripped and will not be clamped. This permits the slack take-up member as seen in FIG. 8 of this patent to exert force on the yarn and, coupled with loom vibration, to draw excess yarn through the tensioning device. This produces excessive slack in the yarn, resulting in false loom stops by the stop motion which detects a broken yarn, even through the yarn has not become broken but has just become excessively slack and hinders attempts to correctly position the weft.

The principal object of this invention is to provide an improved yarn brake for textile machine which can be selectively operated for applying braking pressure to the yarn, so as to apply full tension, partial tension, or no tension to the yarn.

Another object of this invention is to provide a weft yarn braking system for a loom using the improved brake to control the tension on each of the individual yarns precisely, so that when a particular yarn is being fed into the warp shed during insertion of the weft yarn from one side of the loom to the other, all tension is released from the yarn and a partial tension is re-imposed upon the yarn near the end of the weft insertion. During all other times, a full gripping tension is imposed on the yarn.

These and other objects and advantages of the invention will become more apparent from the following detailed description and appended claims taken in conjunction with the accompanying drawings.

SUMMARY OF THE INVENTION

Briefly, the invention provides an improved yarn brake and a weft yarn braking system for a multiple weft loom in which each weft yarn is controlled individually and independently of all of the other weft yarns. Each of the weft yarns is provided with a brake, which is normally urged in yarn braking condition by means of springs and which comprises two solenoids; one for partially releasing braking pressure on the yarn and another for fully releasing braking pressure on the yarn. For example, in the case of a weaving machine with 8 yarns (that is, 4 yarns being inserted from each end of the weaving machine), 4 yarn brakes are provided at each end of the loom and the individual yarns are threaded through respective yarn brakes. Electronic controls are provided that, in response to the weft selection, activate the individual solenoids corresponding to the selected weft yarn at the proper point in the loom cycle so that braking pressure will be completely released during the major portion of weft insertion within the warp shed, partially re-imposed at the end of the insertion and fully re-imposed after weft insertion is completed.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
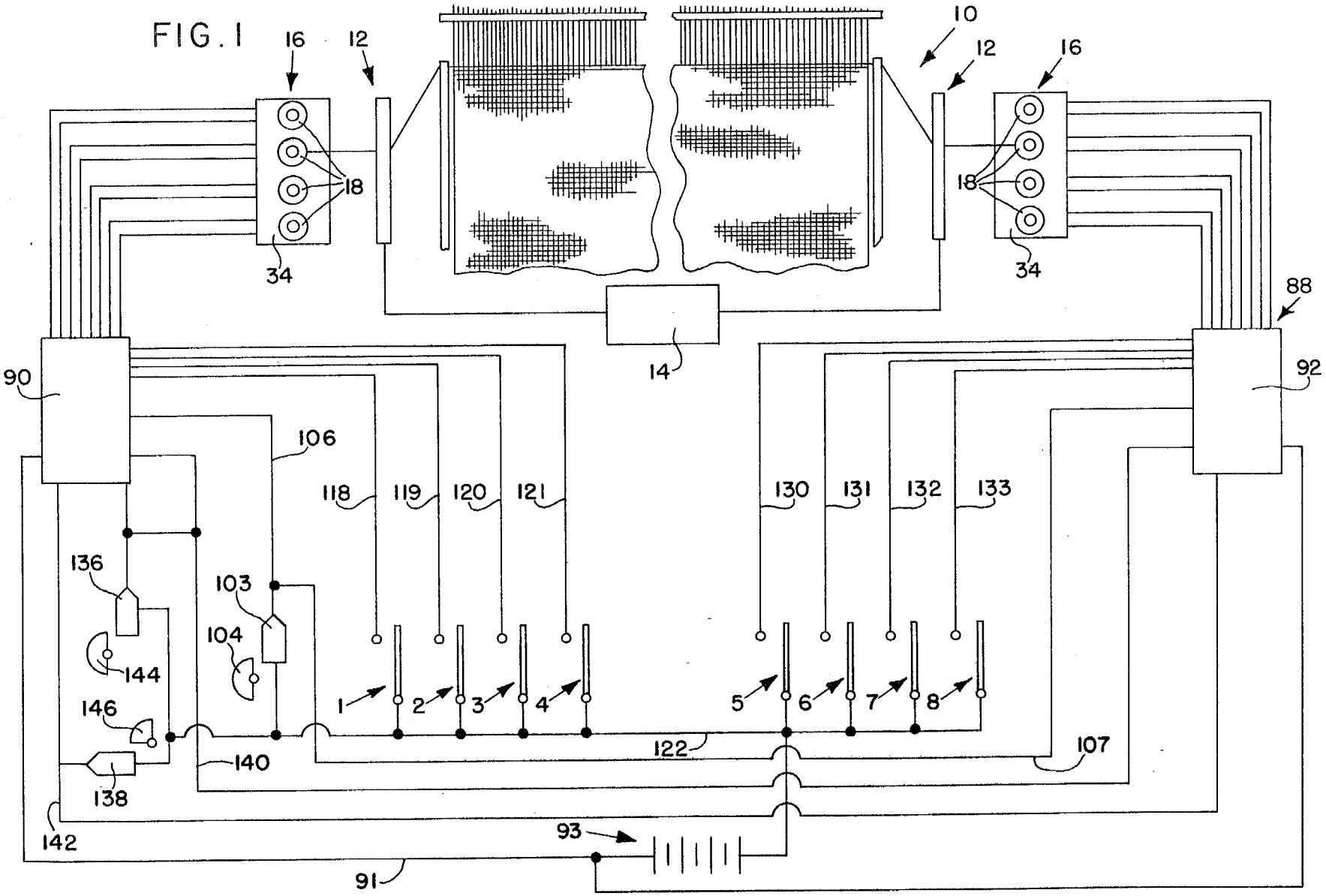
FIG. 1 is a diagrammatic plan view of a loom incorporating the weft yarn braking system according to the invention.

Referring particularly to FIG. 1, the invention is shown applied to a multi-color weaving loom generally indicated by the reference numeral 10. The loom is very generally shown and may be of any conventional type such as that shown for example, in U.S. Pat. No. 3,565,121. The loom includes all of the conventional elements such as a shedding mechanism, weft inserting means, a pattern mechanism, weft selecting and presenting mechanism under the control of the pattern mechanism for selecting one of a plurality of weft yarns and presenting the selected weft yarn to the weft inserting means. In FIG. 1 the pattern mechanism is represented by the reference numeral 14 and there is a yarn presenting means located at each side of the loom and generally indicated by the reference numeral 12. The yarn presenting means is shown in greater detail in FIG. 6.

The yarn braking system of the present invention is generally indicated by the reference numeral 16 and includes a plurality of yarn brakes 18 located at each side of the loom. There is a yarn brake for each weft yarn. As shown for example in FIG. 1, there are four brakes located at each side of the loom. Each weft yarn extends from an outside supply package (not shown) through its respective yarn brake to the yarn presenting mechanism 12.

Figure 6:
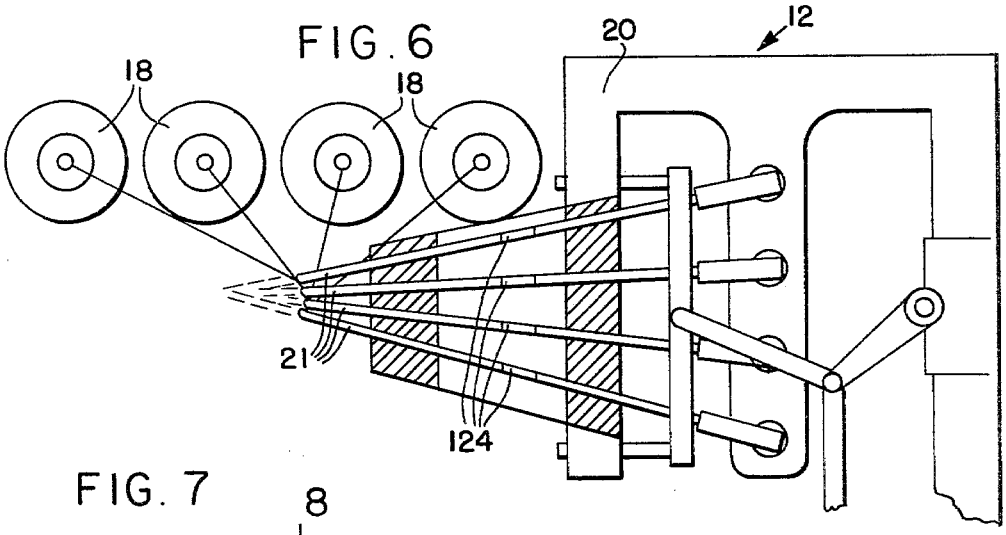
FIG. 6 is a fragmentary view of a weft yarn presenting mechanism which selectively presents yarn to the weft inserting mechanism at one side of the loom.
Figure 7:
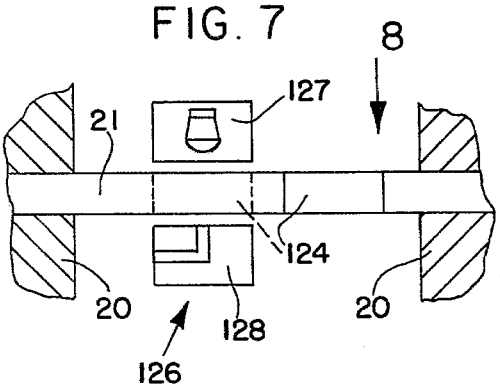
FIG. 7 is a diagrammatic view of a photoelectric switch which is controlled or operated by the weft presenting mechanism of FIG. 6.

As shown in FIG. 6, the weft yarn presenting means includes a stationary support 20 having a plurality of guide bores in which a plurality of presenting elements 21 are mounted. Each presenting element is movable along its longitudinal axis between an inner inactive position and an outer active position. Each yarn presenting element 21 has a guide eye at one end through which the weft yarn passes (the left-hand end as shown in FIG. 6). When a particular weft yarn is selected for insertion into the warp shed, the corresponding presenting element is moved from the full line position to the dotted line position to present the weft yarn to the weft inserting means. As shown in FIG. 6, all of the presenting elements converge to a single yarn presenting point. (See the above-referenced U.S. Pat. No. 3,565,121 for a more detailed showing and description of the yarn presenting mechanism).

Figure 2:
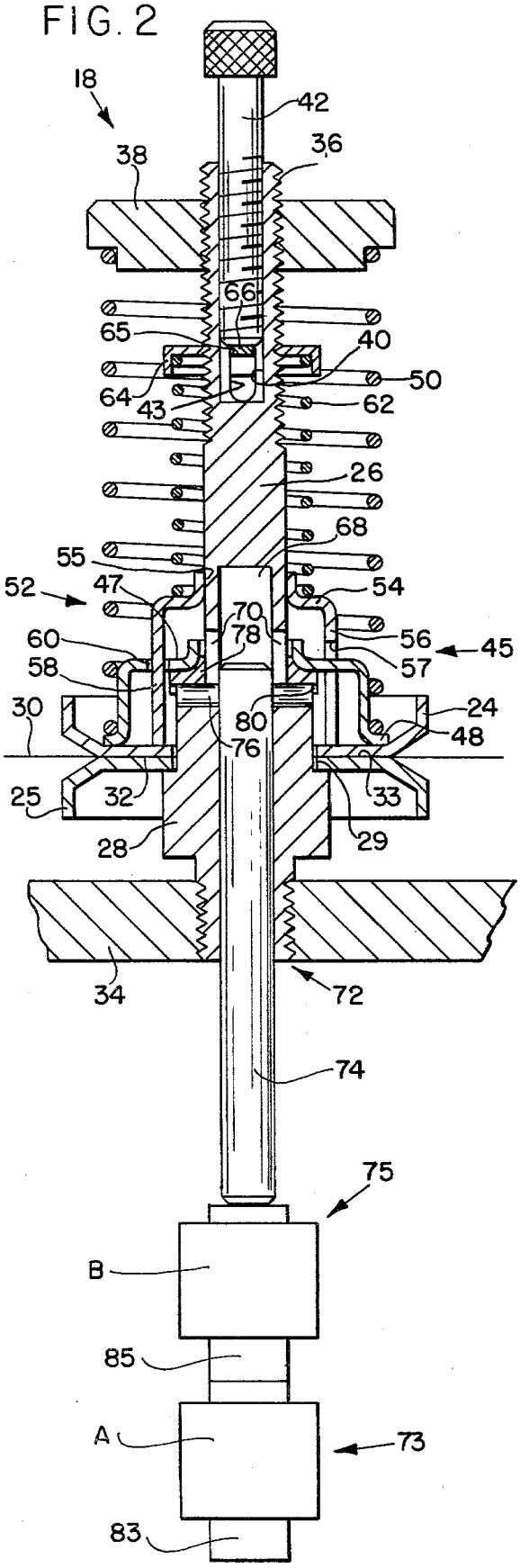
FIG. 2 is a vertical sectional view of the yarn brake of the present invention, shown in the full braking condition.
Figure 3:
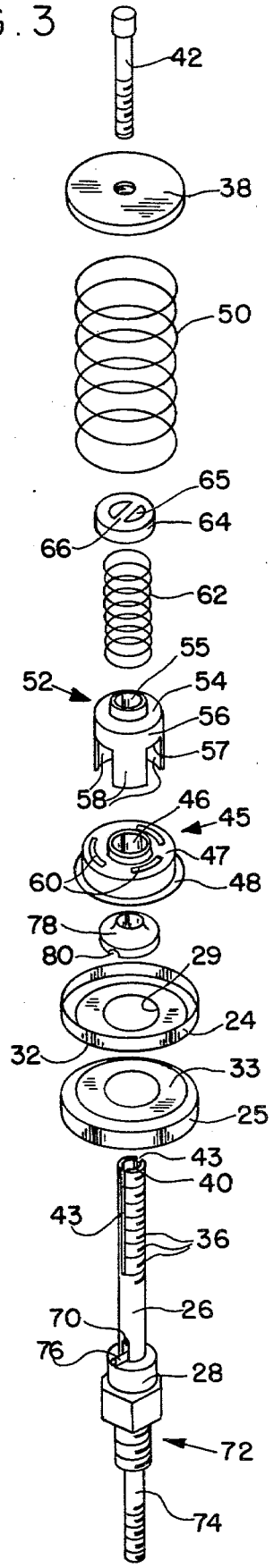
FIG. 3 is an exploded perspective view of the yarn brake.

Referring to FIGS. 2 and 3, one of the yarn brakes of the present invention is shown in greater detail. Yarn brake 18 comprises upper and lower disc-shaped clamping plates 24 and 25, respectively mounted concentrically about a shaft 26. The lower plate 25 rests on a annular shoulder 28 of shaft 26 and remains stationary. The upper plate 24 is provided with a central opening 29 which allows plate 24 to be moved along the central longitudinal axis of shaft 26. The yarn 30 to be braked extends between plates 24 and 25 in contact with the oppositely-facing clamping surfaces 32 and 33 of plates 24 and 25, respectively. The lower portion of shaft 26 is threaded into a supporting member 34. A large diameter nut 38 is threaded on the upper portion 36 of shaft 26. The upper portion 36 of shaft 26 also has a threaded bore 40 for receiving a screw 42. A pair of longitudinal slots 43 extend from the bore to the outside of the shaft 26.

Movable plate 24 is normally held against plate 25 by the combined forces provided by first and second biasing means. The second biasing means comprises a large diameter cap-shaped impinger 45 provided with a central opening 46 which enables the impinger to be mounted concentrically about the shaft 26. The lower end of impinger 45 is provided with an annular flange 48 which rests on clamping plate 24. A large diameter spring 50 extends between the nut 38 and flange 48 to provide a biasing force against plate 24. The first biasing means comprises a small diameter cap-shaped impinger 52 has an upper end wall 54 provided with a central opening 46 which allows the impinger to be concentrically mounted on shaft 26 for movement along the central longitudinal axis of the shaft. Impinger 52 has a side wall 56 extending downwardly from upper end wall 54 and terminating in a lower edge 57. Three vertical legs 58 extend downwardly from lower edge 57 through apertures 60 in the upper wall 47 of the large diameter impinger 45. Legs 58 extend to clamping plate 24. The length of legs 58 are such that lower edge 57 is spaced from the upper end wall 47 when both impingers are in contact with movable clamping plate 24. Impinger 52 is forced against the movable clamping plate 24 by means of a small diameter coil spring 62 that extends from the upper wall 54 to a washer 64 slidably mounted on shaft 26 below nut 38. Washer 64 has a central opening 65 across which extends a transverse rib 66 which is slidably mounted in slots 43 in the upper portion 36 of shaft 26. Spring 62 forces washer 64 upwardly so that rib 66 engages the lower end of screw 42. In this way, washer 64 may be raised or lowered by turning screw 42 to adjust the biasing force of spring 62 on plate 24 through the impinger 52. The biasing force of the large diameter spring 50 is adjusted by turning screw 38. The lower end of shaft 26 has a bore 68 and a pair of longitudinal slots 70 extending from the bore to the outside of the shaft.

Disengaging means for nullifying the biasing effect of springs 50 and 62 include a transmitter mechanism generally indicated by the reference numeral 72, a first actuator generally indicated at 73, and a second actuator generally indicated at 75. Transmitter mechanism 72 comprises a plunger or push rod 74 slidably mounted within bore 68 and a cross pin 76 extending laterally through the upper portion of the push rod. Pin 76 extends beyond the push rod and engages a groove 80 in the bottom surface of a washer 78 loosely mounted concentrically about shaft 26 below the upper end wall 47 of impinger 45.

Figure 4:
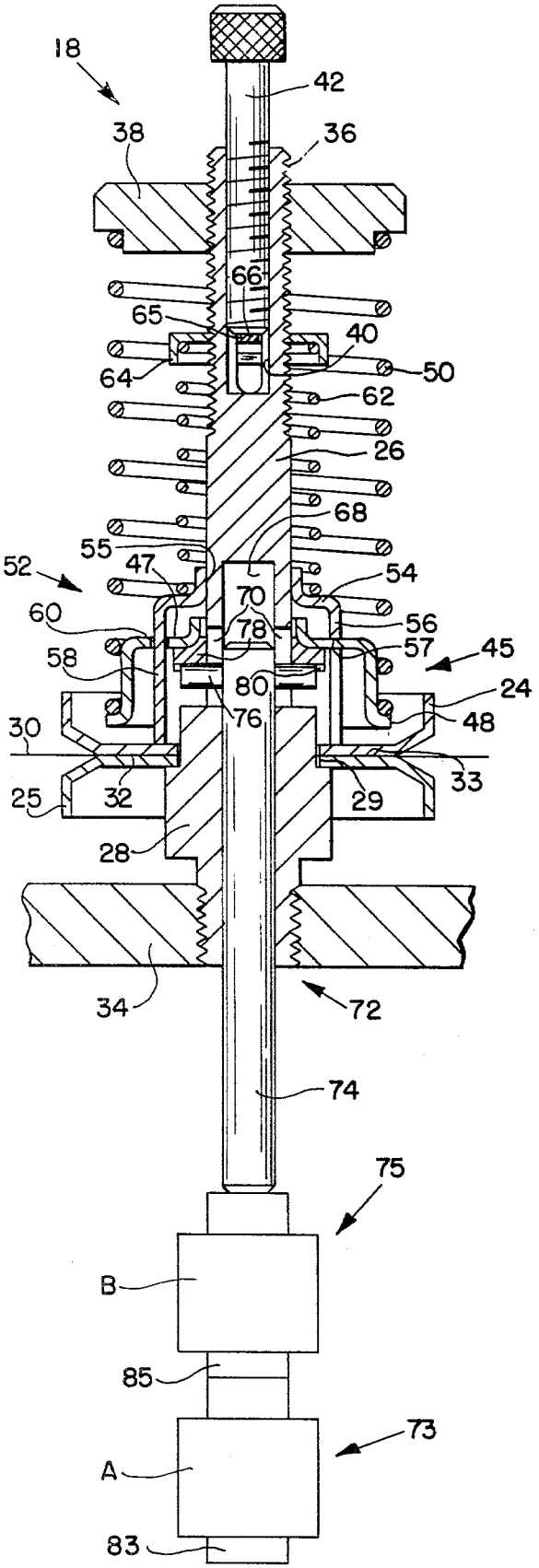
FIG. 4 is a view similar to FIG. 2 showing the yarn brake in the partial braking condition.
Figure 5:
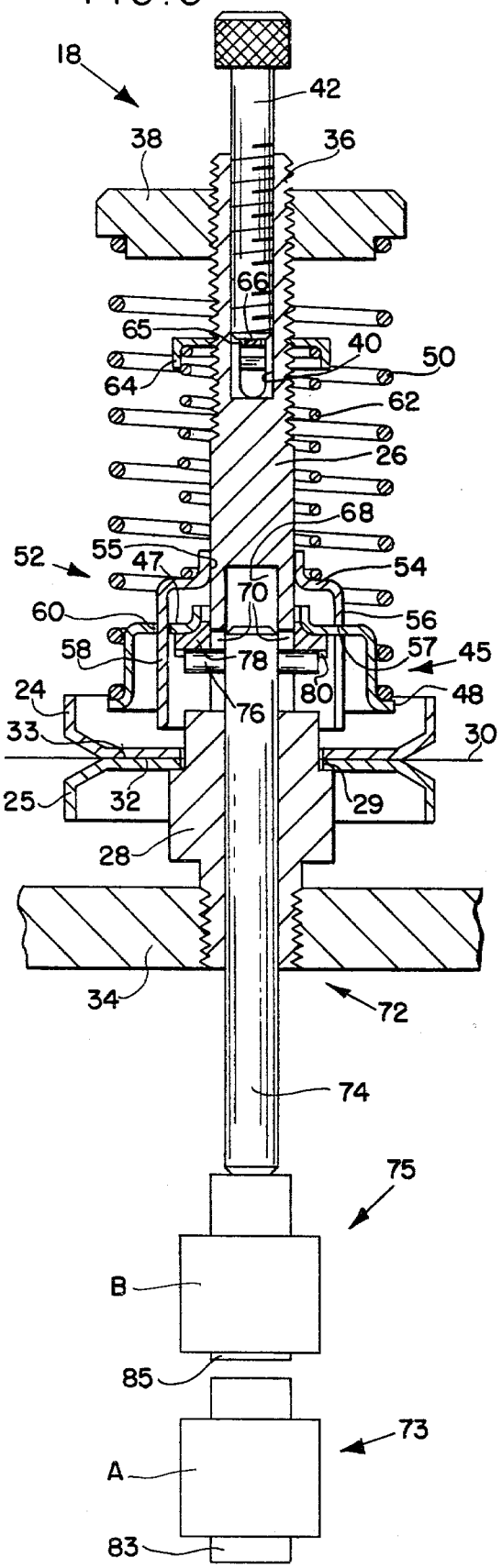
FIG. 5 is a view similar to FIG. 2 showing the yarn brake in the non-braking condition.

First actuator 73 comprises a solenoid A having a movable core 83 located below and in axial alignment with push rod 74. Second actuator 75 comprises a solenoid B having a movable core 85 located between push rod 74 and core 83 in axial alignment with push rod 74. As shown in FIG. 2, the transmitter mechanism 72 occupies an inactive position in which the springs 62 and 50 both exert a biasing force against clamping plate 24. In this condition, plate 24 is forced against plate 25 to provide full braking pressure against yarn 30 extending between the plates. Actuation of solenoid A causes its core 83 to move upwardly and push core 85 of solenoid B upwardly against the bottom of push rod 74, thereby moving push rod 74 to a first active position as shown in FIG. 4. When push rod 74 is moved to its first active position, pin 76, acting through washer, 78 lifts impinger 45 away from clamping plate 24. Since spring 50 engages impinger 45, the biasing effect of spring 50 on clamping plate 24 is removed or nullified. Since impinger 52 remains in contact with clamping plate 24, the biasing effect of spring 62 against the plate is maintained, thereby producing a partial braking of the yarn 30. Actuation of solenoid B causes its core 85 to move upwardly and raise push rod 74 to a second active position, as shown in FIG. 5. In this second active position, impinger 45 is lifted an additional amount by cross pin 76. When push rod 74 occupies the first active position, as shown in FIG. 4, the upper end wall 47 of impinger 45 is located just below the lower edge 57 of impinger 52. When the push rod 74 moves from the first active position in FIG. 4 to the second active third position in FIG. 5, the additional upward movement of impinger 45 causes end wall 47 to engage the lower edge 57 of impinger 52 and raise impinger 52 away from clamping plate 24. Since spring 62 engages impinger 52, lifting of impinger 52 away from the clamping plate 24 removes or nullifies the biasing effect of spring 62 on the clamping plate. This eliminates all biasing pressure against the clamping plate, thereby allowing yarn 30 to be drawn between plates 24 and 25 with minimum tension, provided solely by the weight of clamping plate 24. Since all positive clamping pressure from the springs 50 and 62 is removed from the clamping plate, the brake is considered to be in a non-clamping condition.

Figure 9:
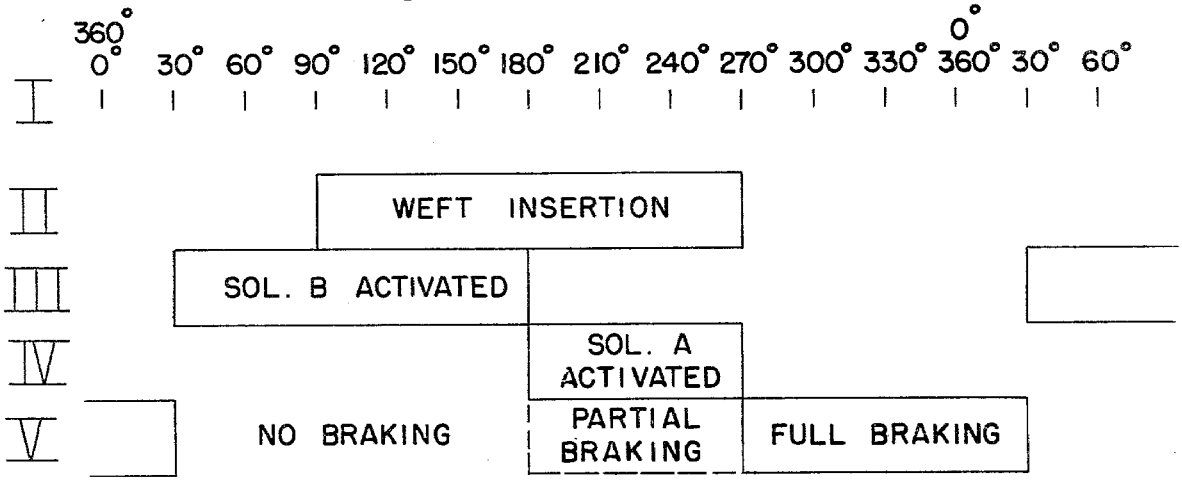
FIG. 9 is a timing diagram illustrating the cycle of the loom and the controls of the yarn braking mechanism for an individual weft yarn while it is being inserted into the warp shed of the loom.
Figure 10:
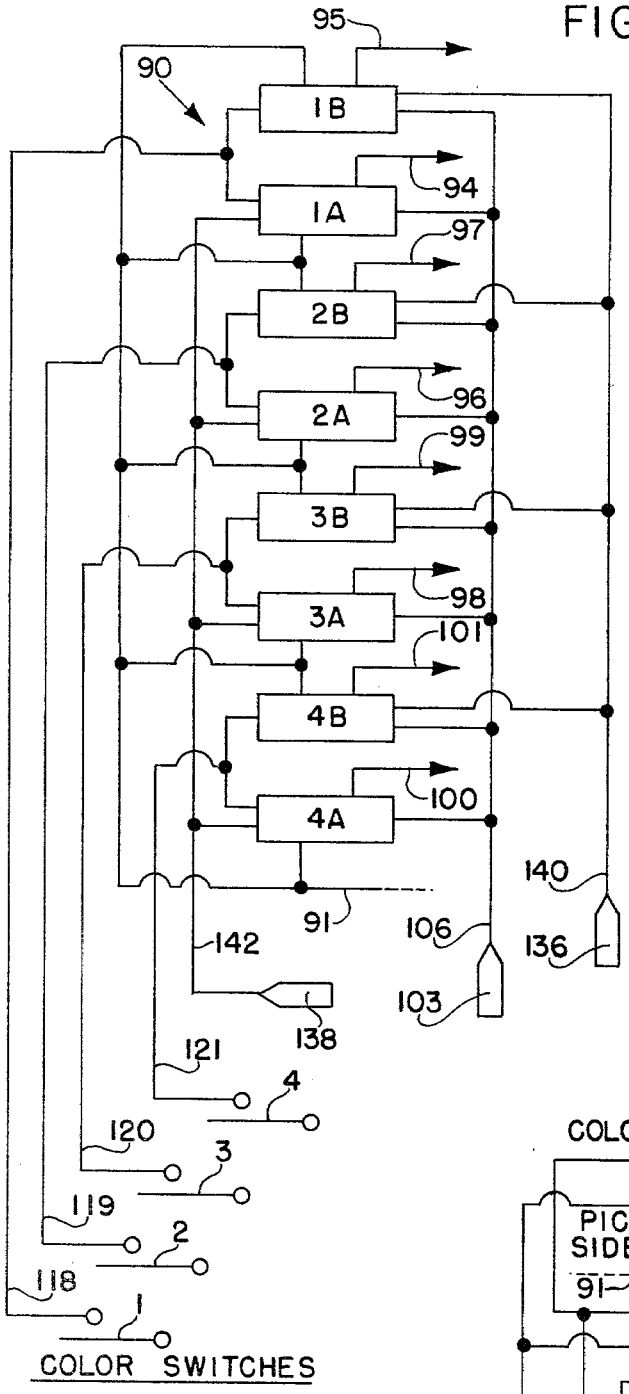
FIG. 10 is a diagrammatic view of the control circuitry for the weft yarn braking system shown in FIG. 1.
Figure 11:
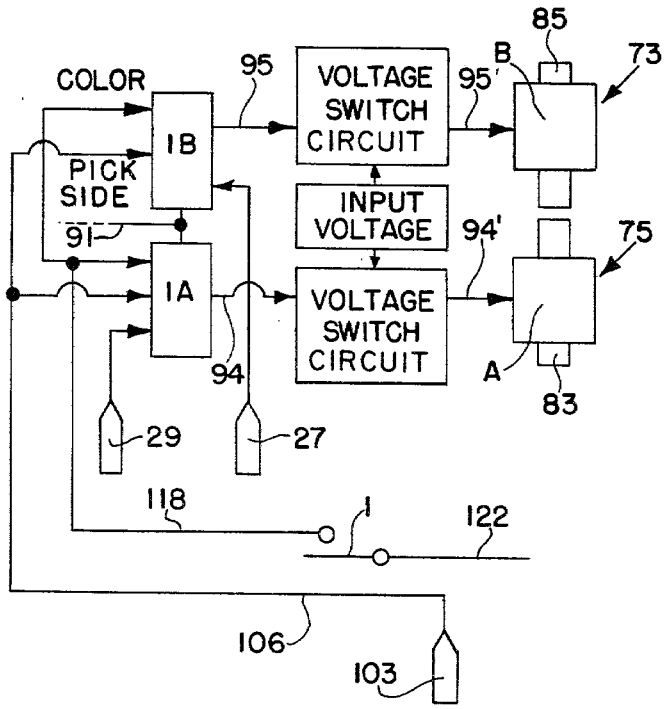
FIG. 11 is a diagrammatic view of the control circuitry for the solenoids of one yarn brake.

The control means for the brakes is shown in FIGS. 1, 10 and 11. Referring particularly to FIG. 1, the control means is generally indicated by the reference numeral 88 and comprises a control and power board 90 for the brakes 18 at the left-hand or head end of the loom and a control and power board 92 for the brakes 18 at the right-hand or drive end of the loom. Each power board is connected to a low-voltage source 93 by a line 91. Each power board contains eight individual low-voltage logic combining circuits which can be of the AND or NAND or NOR type. Each logic combining circuit is designed to produce a low-voltage output signal upon receiving three input signals. The output signals from the circuits are used to actuate the four pairs of solenoids of the four brakes at one side of the loom. The circuits for power board 90 are shown diagrammatically in FIG. 10 and are arranged in four pairs corresponding to the four brakes at the head end of the loom. Circuits 1A and 1B produce output signals 94 and 95, respectively, for controlling the solenoids A and B, respectively, for the first brake. Since the output signal from the combining circuit is a low-voltage pulse, pulse 94 is sent into a voltage switch circuit 102 which amplifies the signal before transmitting it to the solenoid A as pulse 94'. Pulse 95 is sent into a voltage switch circuit 105 which amplifies the signal before transmitting it to solenoid B as pulse 95' to solenoid B, as shown in FIG. 9. Circuits 2A and 2B produce output signals 96 and 97, respectively, for the second brake. Circuits 3A and 3B produce output signals 98 and 99, respectively, for the third brake and circuits 4A and 4B produce output signals 100 and 101, respectively, for the fourth brake. The three input pulses or signals for each combining circuit comprises a pick side signal, a color indication signal and a tension level signal.

Referring to FIGS. 1 and 10, the pick side signal for all of the combining circuits is derived from a switch 103 actuated by a cam 104. Switch 103 is connected to low-voltage source 93 and to all of the combining circuits in each of the power boards 90 and 92. When switch 103 is in one state, a signal is produced in all of the circuits in power board 90. When switch 103 is in the other state, a signal is produced in all of the combining circuits in power board 92. Cam 104 is operatively connected to the loom drive so that it makes one complete revolution for every two weft insertions. Cam 104 actuates switch 103 so that when weft is inserted from the head end of the loom, the circuits in power board 90 receive an appropriate signal from line 106 and when weft is inserted from the drive end side of the loom all of the combining circuits in power board 92 receive an appropriate signal from line 107. Switch 103 is closed during weft insertions from one side of the loom and opened for weft insertions from the opposite side of the loom. Therefore, the logic circuits in power board 90 differ from those in power board 92 in that in one case, one of the three signals required to produce an output pulse is a positive signal from switch 103 and in the other case, one of the three signals required to produce an output pulse is a negated signal from switch 103.

Referring to FIGS. 1, and 6 thru 8, the second signal (indicative of color or weft insertion) for the logic circuits in power board 90 is received indirectly from the pattern mechanism 14 through the weft yarn presenting means 12 at the head end of the loom. The weft presenting mechanism 12 is described in greater detail in the Svaty U.S. Pat. No. 3,565,121. The weft presenting mechanism shown herein is only an example of the many types of weft presenting mechanism that may be used with the present invention. All that is required is a plurality of movable elements corresponding to a plurality of diverse wefts for selectively actuating a plurality of color indicator switches. In the present case, the four presenting elements 21 each have a projecting finger 124. There is a photoswitch 126 comprising a transmitter element 127 and a receiver element 128 associated with each yarn presenting element 21. The photoswitch 126 is spaced laterally of the yarn presenting element 121. The projecting finger 124 extends laterally of the presenting element 21, so that when the element 21 moves from the inactive position (as shown in full lines in FIG. 7) to the active position indicated by dotted lines, projecting finger 124 passes between the transmitter and receiver elements 127 and 128, as indicated by dotted lines in FIG. 7. This interrupts the light beam from transmitter element 127 and actuates switch 126 to transmit a color indicator signal to the pair of logic circuits in power board 90 for the particular corresponding brake 18 at the head end of the loom. This signal corresponds to the particular weft yarn presented by weft presenting means 12. The four color switches 126 corresponding to the four diverse weft yarns at the head end drive of the loom are shown diagrammatically and are represented by numbers 1–4. Switches 1–4 are connected to power board 90 by lines 118–121, respectively, and to low-voltage source 93 by lines 122.

Referring particularly to FIG. 10, color switch 1 is connected to the first pair of logic circuits 1A and 1B by a line 118. Switch 2 is connected to logic circuits 2A and 2B by a line 119. Switch 3 is connected to logic circuits 3A and 3B by a line 120 and switch 4 is connected to logic circuits 4A and 4B by a line 121. When one of the color switches 1–4 is closed, a second signal is transmitted to the corresponding pair of logic circuits.

The weft presenting mechanism 12 at the drive end of the loom has four switches 126 corresponding to the four diverse weft yarns at the head end of the loom. Switches 126 are shown diagrammatically in FIG. 1 and represented by numbers 5–8 corresponding to the four diverse wefts at the drive end of the loom. Switches 5–8 are connected to power board 92 by lines 130–133, respectively, and to low-voltage source 93 through line 122. Switches 5–8 are connected to logic circuits in power board 92 in the same manner as switches 1–4 are connected to the logic circuits in power board 90, as shown in FIG. 10.

Figure 8:
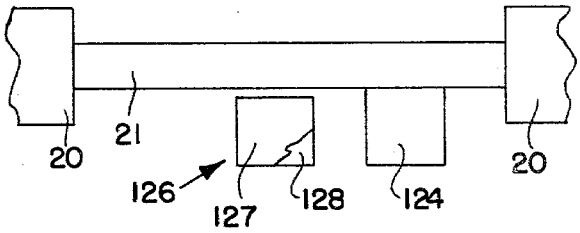
FIG. 8 is a diagrammatic view of the photoelectric switch, looking in the direction of arrow VIII of FIG. 7.

Referring to FIGS. 1, 10, 11, the logic circuits in power boards 90 and 92 receive a third signal from either a tension level switch 136 or a tension level switch 138. Switch 136 is connected to power boards 90 and 92 by a line 140 and switch 138 is connected to power boards 90 and 92 by a line 142. As shown in FIG. 8, switch 136 is connected to logic circuits 1B, 2B, 3B and 4B for actuating solenoid B for each of the respective brakes 18. Switch 138 is connected to logic circuits 1A, 2A, 3A and 4A for actuating solenoid A for each of the respective brakes 18. As shown in FIG. 1, switches 136 and 138 are actuated by cams 144 and 146. Each of the cams 144 and 146 is operatively connected to the loom drive so that it makes one complete revolution for each weft insertion. The timing of the cams 144 and 146 is such that switch 136 is closed during a portion of each weft inserting cycle and switch 138 is closed during the remaining portion of weft inserting cycle. Switches 103, 136 and 138 are all depicted in FIG. 1 as magnetically-operated switches, although the invention is not limited to any particular type of switch. The logic circuits in power board 92 are connected to switches 136 and 138 in the same manner as the logic circuits in power board 90 as shown in FIG. 10.

The operation of the present invention will now be readily understood in view of the above description.

Referring to FIG. 9, there is shown a timing diagram showing the activation sequence of a brake 18 through a complete weft insertion cycle. Line I indicates the number of degrees of crankshaft rotation, 0° or 360° indicating the point when the lay is at front center position. Line II indicates the weft insertion cycle which begins at approximately 85° and finishes at approximately 270°. Line III indicates the activation period of solenoid A and line IV indicates the activation period of solenoid B. Line V indicates the braking state of brake 18 as controlled by its solenoids A and B.

At the beginning of a weaving cycle, starting from the time of weft beat-up at 0° or 360° crankshaft time, all of the brakes 18 are in the full braking condition. Solenoids A and B for each brake 18 are de-activated at this time, as shown in FIG. 11. Also, at this time, the pattern mechanism indicates which of the diverse wefts is to be inserted and the appropriate color switch is closed. If, for example, the next weft insertion is from the head end side of the loom and the weft corresponding to switch No. 1 is to be inserted, switch No. 1 is closed, thereby transmitting a signal to circuits 1A and 1B. At this time, a signal is also transmitted to all of the circuits in power board 90 from switch 103. At approximately 30°, switch 136 is closed to transmit a signal to all of the B circuits. However, since only circuit 1B has received two previous signals it will be the only circuit to generate an output pulse to thereby activate its solenoid B. This causes core 85 to lift the push rod 74 of the corresponding brake 18 to the non-braking condition shown in FIG. 5. The weft yarn 30 extending between the clamping plates of the de-activated brake corresponds to the selected weft yarn indicated by the closing of switch 1. Release of all braking pressure on this selected weft yarn allows the yarn to be freely inserted into the warp shed beginning at approximately 85°. During the latter portion of the weft insertion, switch 138 is closed for transmitting a signal to circuit 1A. This causes circuit 1A to produce an output pulse 94 for activating solenoid A of the corresponding brake 18. At the same time, switch 136 opens, thereby de-activating solenoid B. However, activation of solenoid A and the resultant lifting of its core 83 prevents core 85 of solenoid B from dropping to its lower inactive position. Core 85 is supported by core 83 in an intermediate position, thereby supporting push rod 74 in the partial braking position shown in FIG. 4. The weft yarn being inserted is thereby partially braked during the latter part of its insertion, as long as solenoid A is activated, as indicated in lines IV and V of FIG. 11. At the end of the weft insertion, switch 138 opens and solenoid A is deactivated, thereby allowing push rod 74 to return to its original full braking position shown in FIG. 2.

The invention having been thus described, what is claimed as new and desired to secure by Letters Patent is:

1. A weft yarn braking system in a loom having means for selectively inserting a plurality of diverse yarns from each side of the loom, said loom having a pattern mechanism, weft yarn inserting mechanism, weft yarn selecting and presenting mechanism at each side of the loom and operatively connected to the pattern mechanism for presenting a selected weft yarn to the weft yarn inserting mechanism, said weft yarn braking system comprising:

(a) a brake for each weft yarn at each side of the loom, each brake comprising:
  (1) a stationary clamping plate;
  (2) a movable clamping plate mounted for movement toward and away from the stationary clamping plate, wherein the weft yarn associated with said brake extends between said plates;
  (3) first biasing means for biasing the movable clamping plate against the stationary clamping plate;
  (4) second biasing means for biasing the movable clamping plate against the stationary clamping plate;
  (5) electro-magnetic disengaging means for receiving a first actuation and a second actuation, and operable from a normally inactive neutral position to a first active position upon receiving said first actuation and to a second active position upon receiving said second actuation, said disengaging means being effective in said first active position to disengage the first biasing means from the movable clamping plate to remove part of the braking pressure from said associated weft yarn, and effective in said second position to disengage the first and second biasing means to remove all braking pressure from said associated weft yarn;

(b) control means operatively connected to each brake and operating in timed relation to the loom for providing a second actuation to the electro-magnetic disengaging means of the brake associated with the selected weft yarn for disengaging the first and second biasing means of said associated brake during the initial major portion of the insertion of said selected weft yarn, and for providing a first actuation to the electro-magnetic disengaging means of said associated brake during the latter minor portion of the insertion of said selected weft yarn, whereby all braking pressure is removed from said selected weft yarn during said major portion and a portion of the braking pressure is removed from said selected weft yarn during said minor portion.

2. A weft yarn braking system as recited in claim 1, wherein the first biasing means provides a substantially stronger biasing force against the movable plate than the second biasing means.

3. A weft yarn braking system as recited in claim 2, wherein each of said biasing means is a coiled compression spring.

4. A weft braking system as recited in claim 1, wherein means are provided for adjusting the biasing force of each of said first and second biasing means.

5. A weft yarn braking system as recited in claim 1, wherein said control means comprises:

(a) a first logic circuit for each brake, each of said first logic circuits being effective to provide a first actuation to its brake upon receiving three electrical signals;

(b) a second logic circuit for each brake, each of said second logic circuits being effective to provide a second actuation to its brake upon receiving three electrical signals;

(c) a pick indicator for transmitting an electrical signal to the first and second logic circuits of each brake located at the side of the loom from which the selected weft yarn is inserted;

(d) a color indicator for transmitting a signal to the first and second logic circuits of the brake associated with the weft yarn selected for insertion into the loom;

(e) a full release indicator for transmitting an electrical signal to the second logic circuits of all the brakes during a major portion of each weft insertion, and (f) a partial release indicator for transmitting an electrical signal to the first logic circuits of all the brakes during the latter part of each weft insertion.

6. A weft yarn braking system as recited in claim 5, wherein the weft yarn selecting mechanism includes a movable element for each weft yarn which, upon receiving an indication from the pattern mechanism, moves from an inactive position to an active position for presenting the weft yarn to the weft inserting mechanism, said color indicator comprising:

(a) a color switch for each weft yarn; and (b) a projecting finger extending from each movable element for actuating the color switch corresponding to the selected weft yarn.

7. A weft yarn braking system as recited in claim 6, wherein each of said color switches is a photo-switch comprising:

(a) a transmitter element for transmitting a light beam; and (b) a receiver element spaced from the transmitter element for receiving said light beam and effective upon interruption of said light beam to transmit an electrical signal, said photo-switch being positioned so that the projecting finger of the corresponding movable elements interrupts said light beam when the movable element moves to the active position.

8. A weft yarn braking system as recited in claim 1, wherein each electro-magnetic disengaging means comprises:

(a) a transmitter mechanism operatively connected to the first and second biasing means, said transmitter mechanism normally occupying an inactive position and movable to a first active position and to a second active position, said transmitter mechanism being effective in said first active position to disengage said first biasing means and effective in said second position to disengage the first and second biasing means;

(b) a first solenoid for receiving said first actuation and for moving the transmitter mechanism to said first active position upon receiving said first actuation; and (c) a second solenoid for receiving said second actuation and for moving the transmitter mechanism to said second active position upon receiving said second actuation.

9. A weft yarn braking system as recited in claim 8, wherein the transmitter mechanism includes a plunger movable along an axis, the first solenoid includes a core movable along said axis, and the second solenoid includes a core movable along said axis and located between the plunger and the core of the first solenoid, the core of the second solenoid acting directly on the plunger for moving the transmitter mechanism to the first active position, the core of the first solenoid acting indirectly on the plunger through the core of the second solenoid for moving the transmitter mechanism to the second active position.

10. A yarn brake comprising:

(a) a supporting member;

(b) a stationary clamping plate mounted on the supporting member and having a first flat surface;

(c) a movable clamping plate having a second flat surface parallel to and facing said first flat surface, said movable clamping plate normally resting on the stationary clamping plates and being guided on the supporting member for movement transversely of said flat surfaces to allow a yarn to be drawn along its axis between said surfaces with minimum tension;

(d) a first biasing means for applying pressure to the movable clamping plate and forcing said movable clamping plates against the stationary clamping plate to apply a partial braking pressure against said yarn, said first biasing means comprising a first impinger in contact with the movable clamping plate and mounted on the supporting member for movement transversely of the first flat surface and a first spring in contact with said first impinger for forcing said impinger against the first clamping plate;

(e) a second biasing means for applying pressure against the movable clamping plate and forcing said movable clamping plate against the stationary clamping plate said second biasing means comprising a second impinger in contact with the movable clamping plate and mounted on the supporting member for movement transversely of the first flat surface and a second spring in contact with the second impinger for forcing the impinger against the first clamping plate so that the combined pressure exerted by the first and second biasing means against the movable clamping plate causes the movable clamping plate to apply full braking pressure against said yarn; and (f) disengaging means for selectively nullifying the biasing effect on the movable clamping plate of the first biasing means or for nullifying the biasing effect on the clamping plate of the second biasing means in addition to the first biasing means.

11. A yarn brake as recited in claim 10, wherein the first impinger is engaged by the transmitter mechanism and moved away from the movable clamping plate a primary movement as the follower mechanism moves from said inactive position to said first active position and a secondary movement from said first active position to said second active position, said first impinger being movable relative to the second impinger for said primary movement, said first impinger being effective to engage the second impinger at the end of said primary movement and to move the second impinger away from the movable clamping member for said secondary movement.

12. A yarn brake as recited in claim 11, wherein the supporting member includes a shaft extending transversely through the centers of the clamping plates for guiding the movable clamping plate, the first impinger comprising a relatively large diameter cap mounted on the shaft for movement along the axis of the shaft, said large diameter cap having an end wall provided with an aperture and a side wall extending from the end wall to the movable clamping plate, the second impinger comprising a relatively small diameter cap mounted on the shaft for movement along the axis of the shaft, said small diameter cap having an end wall, a side wall extending from the end wall toward the movable clamping plate and terminating in an edge spaced from the end wall of the large diameter cap, and a leg portion that extends from said edge through said aperture and engages the movable clamping plate, whereby the large diameter cap moves along the leg portion during said primary movement at the end of which the end wall engages the lower edge of the small diameter cap, thereby causing both of said caps to move together during said secondary movement.

13. A yarn brake as recited in claim 12, wherein the shaft extends beyond the stationary clamping plate and is provided with a bore extending from the end of the shaft to said caps and an axial slot extending from said bore to the outside of said shaft, said transmitter mechanism comprises a plunger slidably mounted within said bore and provided with a cross pin extending through said slot for engaging the small diameter cap.

14. A yarn brake as recited in claim 13, wherein the first biasing means is a relatively large diameter coil spring concentric with said shaft and engaging the large diameter cap, the second biasing means is a relatively small diameter spring concentric with said shaft within the large diameter spring and engaging the small diameter cap.

15. A yarn brake as recited in claim 14, wherein the opposite end of said shaft extends beyond said caps and has external threads, a nut is threaded on said opposite end, for engaging the large diameter spring and adjusting the compressive force exerted by said large diameter spring against the large diameter cap.

16. A yarn brake as recited in claim 15, wherein the threaded opposite end of the shaft has a threaded bore and an axial slot extending from the bore to the outside of the shaft, a washer is slidably mounted on the threaded end of the shaft between the caps and nut and has a guide flange extending into said slot, the small diameter spring extending between the washer and small diameter cap, a pin is threaded into the bore and engages the guide flange for adjusting the compressive force exerted by said small diameter spring against the small diameter cap.

* * * * *